US007240423B2

(12) United States Patent
Yang et al.

(10) Patent No.: US 7,240,423 B2
(45) Date of Patent: Jul. 10, 2007

(54) METHOD FOR FABRICATING MESH OF FIELD EMISSION DISPLAY AND STRUCTURE THEREOF

(75) Inventors: Frank Yang, Guanyin Township, Taoyuan County (TW); Yao-Zong Chen, Guanyin Township, Taoyuan County (TW)

(73) Assignee: TECO Nanotech Co. Ltd., Taoyuan (TW)

( * ) Notice: Subject to any disclaimer, the term of this patent is extended or adjusted under 35 U.S.C. 154(b) by 147 days.

(21) Appl. No.: 11/254,912

(22) Filed: Oct. 21, 2005

(65) Prior Publication Data

US 2006/0051984 A1 Mar. 9, 2006

Related U.S. Application Data

(62) Division of application No. 10/883,717, filed on Jul. 6, 2004, now abandoned.

(51) Int. Cl.
*H01R 43/00* (2006.01)

(52) U.S. Cl. ..... 29/825; 29/592.1; 29/595; 29/846

(58) Field of Classification Search ..... 29/592.1, 29/595, 825, 846
See application file for complete search history.

(56) References Cited

U.S. PATENT DOCUMENTS 2,453,118 A * 11/1948 Buckingham et al. ..... 313/46

* cited by examiner

*Primary Examiner*—Carl J. Arbes

(57) ABSTRACT

A method of fabricating the parallel leading wire in a focusing mesh of field emission display and a structure thereof is provided. A cathode leading wire is formed along one edge of a cathode plate in a field emission display. When the metal mesh is formed on the cathode plate, one edge of the mesh becomes a leading wire parallel to another edge thereof. The leading wire has a designated length and a thickness thinner than the metal mesh. Without applying external force, the parallel leading wire is drooped and contacted the cathode plate because of itself weight. Be way of sintering, parallel leading wire is connected to cathode leading wire and enveloped by the metal mesh within the cathode plate.

7 Claims, 4 Drawing Sheets

METHOD FOR FABRICATING MESH OF FIELD EMISSION DISPLAY AND STRUCTURE THEREOF

This application is a divisional application of U.S. patent application Ser. No. 10/883,717, filed on Jul. 6, 2004 now abandoned.

BACKGROUND OF THE INVENTION

The present invention provides a method of fabricating a parallel leading wire in a focusing mesh of a field emission display and the structure thereof. In particular, it provides a method to fabricate a leading wire connected the metal mesh and the cathode plate in a field emission display. It not only makes the leading wire hard to break apart, but also easy to be enveloped. In addition, the method provided will not exceed the budget, affect the integral structure, and/or occur a short or break circuit. Furthermore, the method will not influence the installment of valid and invalid areas in a system and further simplify the usage of the invalid area.

It is known that the structure of the current field emission displays can be divided as 2, 3 and 4 pole types. The structure of 3 and 4 pole field emission displays both have metal mesh. When applying a controlled voltage to the metal mesh, the electron beams from the cathode plate successfully pass the metal mesh and reflect to the anode plate to display the images. Owing to the material difference with glass colloid, the cathode and anode plates, the metal mesh extends outside of the element and to be deemed as a leading wire. However, the foregoing method cannot provide the structure to be airtight enough, and thereby cause the insufficient vacuum and even sometimes happen air leakage.

In order to overcome the depicted defeats, a metal mesh is entirely enveloped within the cathode and anode plates, and additionally fabricates a leading wire extended outside of the element. Nevertheless, this method has some drawbacks as following:

1. Referring to FIGS. 1 and 2, a three-dimensional leading wire 5 is built between the metal mesh 3 and the cathode plate 4. Printing another leading wire 6 in the cathode plate 4 to extend outside of the element and then reach the purpose of vertical wire joint. Yet, the defeat is the complex process of fabricating and thus results the three-dimensional leading wire 5 easy to occur a short circuit.

2. Referring to FIG. 3, printing a silver colloid leading wire 7 between the metal mesh 3 and the cathode plate 4. However, it only can be used under the between distance is within a designated range. When the distance is beyond the range, the extensibility of silver colloid will exceed itself material allowed. In the application of vertical wire joint, it occurs a bad continuous phenomenon and even a break circuit.

3. Referring to FIGS. 4 and 5, a leading wire 31 extended outside is vertical to the edge of the metal mesh 3. Deforming the leading wire 31 and connecting it to the cathode plate 4. The vertical extension of the leading wire 31 makes the metal mesh 3 deforms and affect the restrained pore structure within the valid area of the metal mesh 3 and thereby increase the invalid area 33.

BRIEF SUMMARY OF THE INVENTION

The present invention is to solve the foregoing problems and avoid the possible drawbacks. The present invention is to fabricate the leading wire of the metal mesh and the cathode plate in a field emission display. The fabrication will not take extra costs, affect the integral structure, and/or occur a short or break circuit. Furthermore, the method will not influence the installment of valid and invalid areas in the structure and further simplify the usage of the invalid area.

Accordingly the present invention includes firstly to fabricate a cathode leading wire along one edge of the cathode plate of a field emission display. After a metal mesh is formed in a cathode plate, a leading wire is fabricated along and parallel to the edge of the metal mesh. The parallel leading wire has a designated length and a thickness thinner than the metal mesh. Without applying external force, the parallel leading wire is drooped and contacted the cathode plate because of itself weight. Be way of sintering, the parallel leading wire is connected with the cathode leading wire and enveloped by the metal mesh in the substrate.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

The above objects and advantages of the present invention will be become more apparent by describing in detail exemplary embodiments thereof with reference to the attached drawings in which.

DETAILED DESCRIPTION OF THE INVENTION

Figure 1:
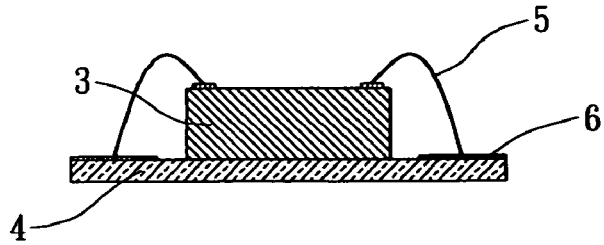
FIG. 1 PRIOR ART
FIG. 1 shows a side view of a joint of a leading wire of the metal mesh and the cathode plate of a conventional field emission display.
Figure 2:
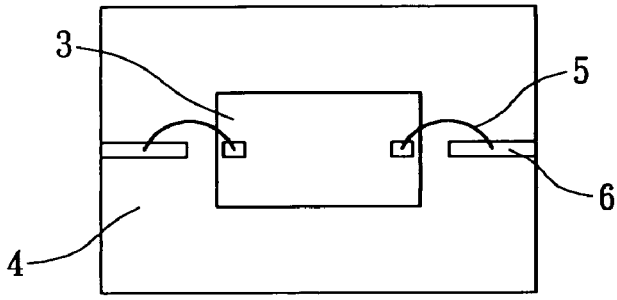
FIG. 2 PRIOR ART
FIG. 2 shows a plan view of a wire joint of the metal mesh and the cathode plate of a conventional field emission display.
Figure 3:
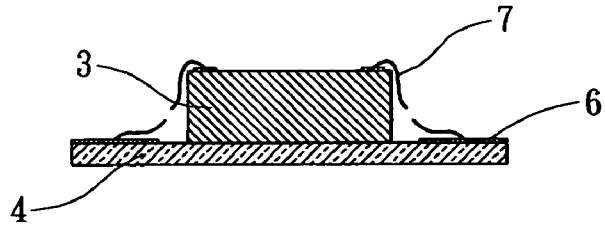
FIG. 3 PRIOR ART
FIG. 3 shows a side view of a bad wire joint of the metal mesh and the cathode plate of a conventional field emission display.
Figure 4:
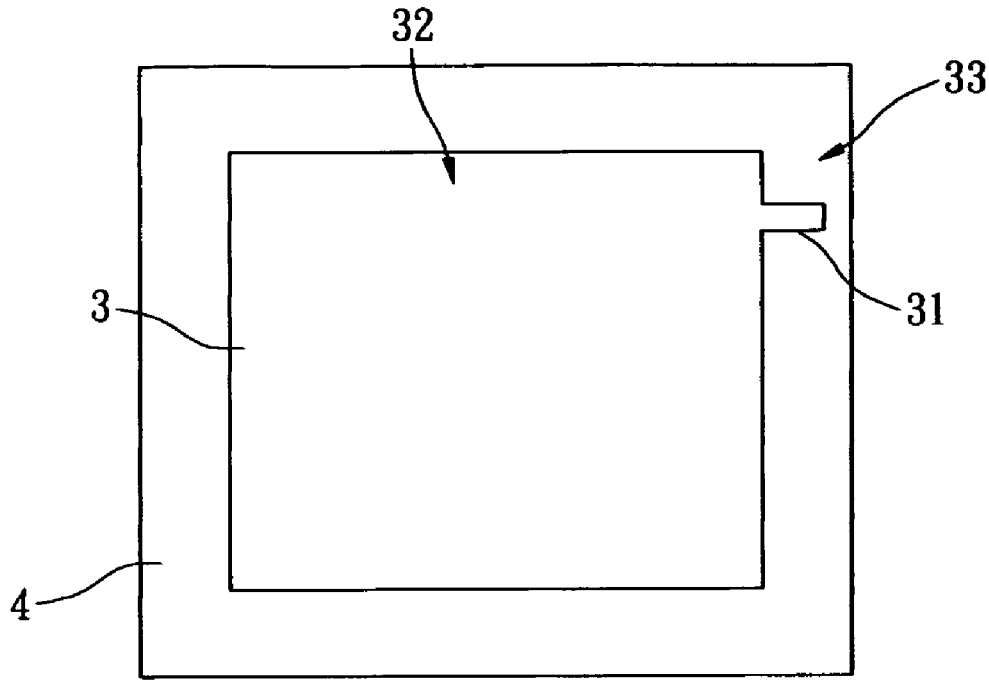
FIG. 4 PRIOR ART
FIG. 4 shows a plan view of an assembly of the metal mesh and the cathode plate of a conventional field emission display.
Figure 5:
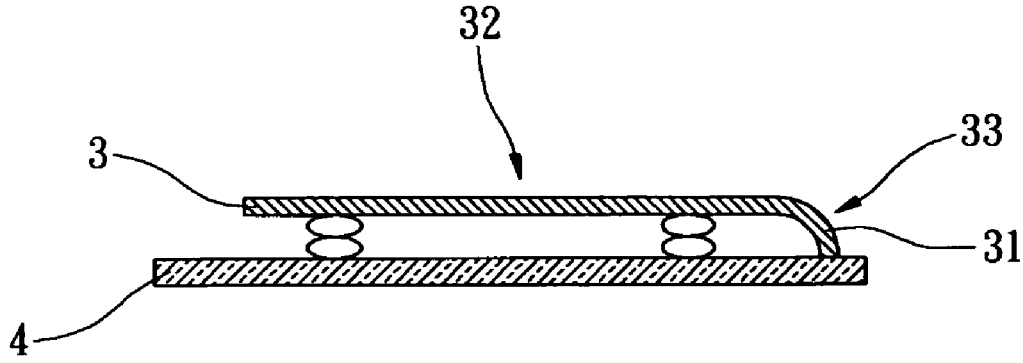
FIG. 5 PRIOR ART
FIG. 5 shows a side view of an assembly of the metal mesh and the cathode plate of a conventional field emission display.

Reference will now be made in detail to the preferred embodiments of the present invention, examples of which are illustrated in the accompanying drawings. Wherever possible, the same reference numbers are used in the drawings and the description to refer to the same or like parts.

Figure 6:
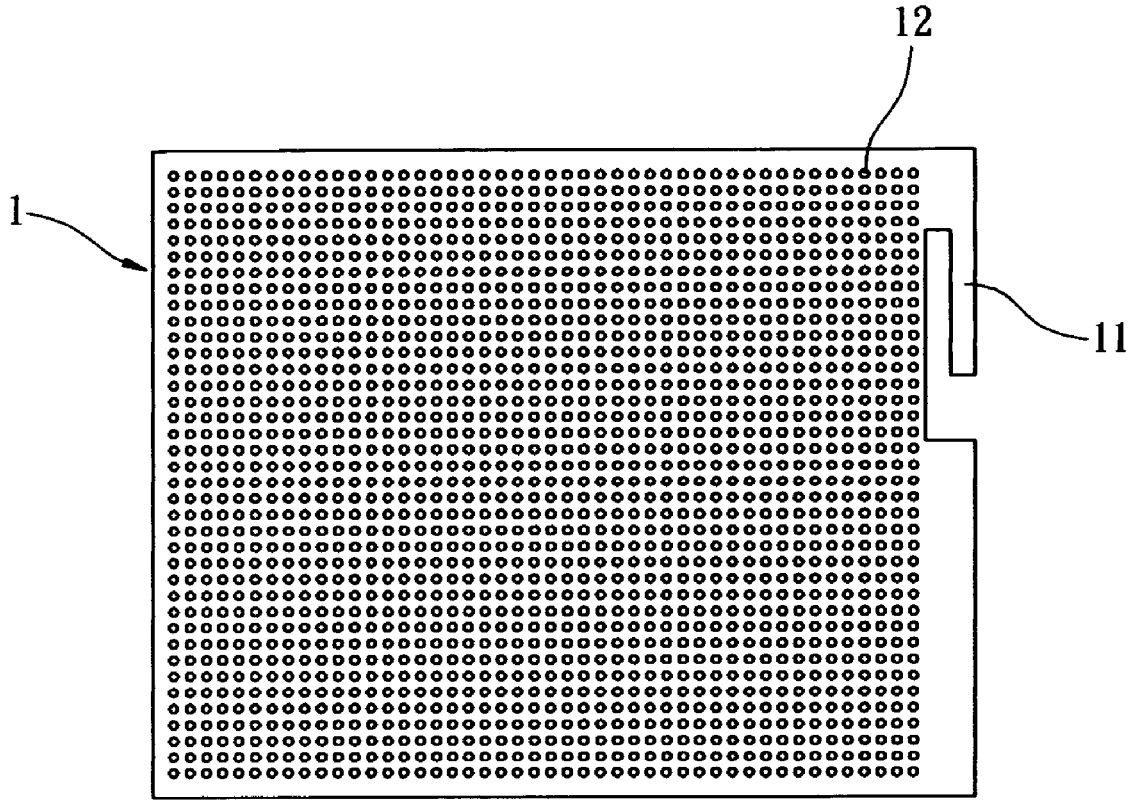
FIG. 6 is a diagram of the metal mesh according to the present invention.
Figure 7:
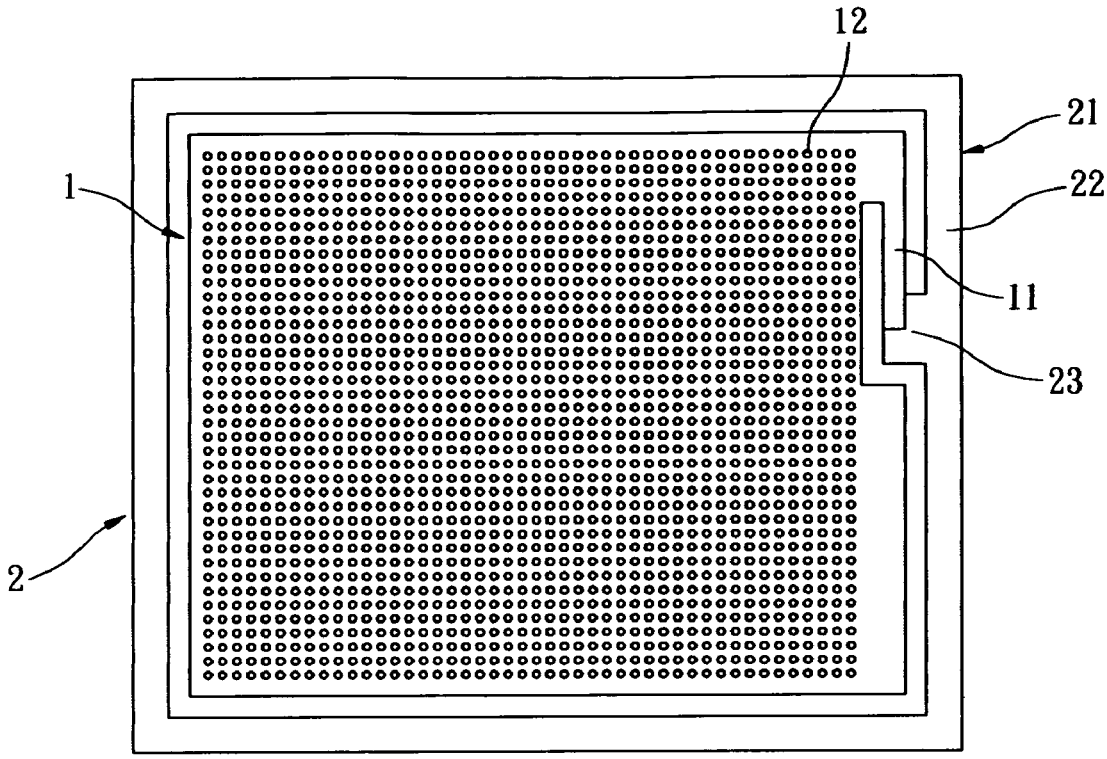
FIG. 7 is a plan view of the metal mesh and the cathode plate according to the present invention.
Figure 8:
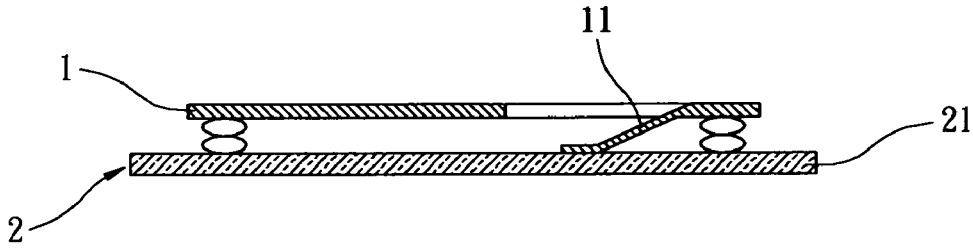
FIG. 8 shows a side view of the metal mesh and the cathode plate according to the present invention.

Please refer to FIGS. 6, 7 and 8, which respectively provide a plan and side view of a joint of a metal mesh and a cathode plate of a field emission display. A method of fabricating a parallel leading wire in a focusing mesh of a field emission display and the structure thereof of the present invention are provided. The metal mesh fabricated in the 3 or 4 pole field emission displays are enveloped in a cathode and anode plates, and thereby make the leading wire of a metal mesh applied a controlled voltage effectively connects to the cathode plate. It will not cause the crack of wire, air leakage and even make easier to be enveloped and increase the good fabrication rate of a field emission display.

In order to envelop the metal mesh 1 into a glass substrate 21, the dimension of the glass substrate 21 of the cathode plate 2 should be larger than the dimension of the metal mesh 1 and allow the metal mesh 1 to be enveloped into a glass substrate 21;

When fabricating the cathode plate 2, the silver colloid is formed along the edge of the glass substrate 21 by method of screen print and/or coating and further forms a cathode leading wire 22. Simultaneously, a joint area 23 is formed in the cathode leading wire 22.

After the metal mesh 1 is formed in the cathode plate 2 by screen printing, coating, photoresisting, and lithography, one edge of the metal mesh 1 forms a leading wire 11 parallel to another edge of the mesh. The parallel leading wire 11 has a designated length, and the thickness of the metal mesh 1 is thinner than 0.2 mm. The square dimension is quite big (8, 12, and even 48 inches) and thereby the ratio of depth is small. According to the theory of cantilever beam, the parallel leading wire 11 can droop to the cathode leading wire 22 of the cathode plate and connect to the joint area 23 without applying an external force. Furthermore, the deformation occurred in the mesh 12 and the metal mesh 1 will not be affected. When the parallel leading wire 11 is connected to the joint area 23 of the cathode leading wire 22, joining the parallel leading wire 11 and joint area 23 by way sintering.

Connecting the parallel leading wire 11 and joint area 23 and proceed to vacuum package. It will prevent the air leakage and crack of the parallel leading wire and further increase the good fabrication rate of a field emission display.

Referring to FIGS. 6 and 7, a plan view of a metal mesh and a joint of the metal mehsgrill and cathode plate are shown. A structure of fabricaring a parallel leading wire of a focusing mesh of a field emission display includes a cathode plate 2,—a metal mesh 1 and a plurality of parallel leading wires 11.

The cathode plate 2 has a glass substrate 21, wherein the edge of the glass substrate 21 forms a cathode leading wire 22, the cathode leading wire 22 forms a joint area 23 in a suitable location.

The metal mesh 1 formed in the cathode plate 2 wherein one edge of the metal mesh has a designated length and a parallel leading wire connected to the joint area 23, wherein the parallel leading wire 11 can be made of same or different material with respect to the metal mesh 11.

The parallel leading wire 11 has a designated length, so it will droop and connect to the joint area 23 by itself weight without the external force is applied. Then, connecting the parallel leading wire to the joint area 23 by method of sintering.

Thus, adding a parallel leading wire 11 on the metal mesh 1 will not take extra costs nor influence the integral structure or a short and break circuit. Furthermore, the method will not influence the installment of valid and invalid areas in a system and fully simplify the usage of invalid area.

Furthermore, when the material of metal mesh 1 is different to the parallel leading wire 11, the parallel leading wire 11 can be made of good conductive metal materials and connected to the metal mesh 1.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. A method of fabricating a parallel leading wire of a focusing mesh of a field emission display, comprising:

forming a cathode leading wire in one edge of a cathode plate;

forming a leading wire parallel to the edge of the mesh formed on the cathode plate, the parallel leading wire having at least a designated length and a thickness thinner than the mesh, which droops and connects to the cathode leading wire of the cathode plate by self weight thereof without an external force applied;

connecting the parallel leading wire with the cathode leading wire by sintering, and enveloping the mesh within the cathode plate; and proceeding to vacuum package to prevent air leakage, break of leading wires and make easier to envelop and increase the good fabrication rate of the field emission display.

2. The method of claim 1, wherein the cathode plate is made of glass material.

3. The method of claim 1, wherein the dimension of the cathode plate is bigger than the dimension of the mesh.

4. The method of claim 1, wherein the cathode leading wire is formed in the edge of the cathode plate by way of screen printing or coating.

5. The method of claim 4, wherein the cathode leading wire forms a joint area in a suitable location.

6. The method of claim 1, wherein the cathode leading wire and the parallel leading wire are made of silver colloid material.

7. The method of claim 1, wherein the mesh is made of same material as the parallel leading wire.

* * * * *